United States Patent [19]

Girard

[11] Patent Number: 4,488,502

[45] Date of Patent: Dec. 18, 1984

[54] MOORING DEVICE

[76] Inventor: William J. Girard, R.R. #1, Morrisburg, Ontario, Canada, K0C 1X0

[21] Appl. No.: 507,632

[22] Filed: Jun. 27, 1983

[30] Foreign Application Priority Data

Dec. 29, 1982 [CA] Canada ..... 418665

[51] Int. Cl.[3] ..... B63B 21/00; B63B 21/54

[52] U.S. Cl. ..... 114/230; 441/3

[58] Field of Search ..... 114/219, 220, 230, 231; 119/107, 122, 123; 441/3, 4, 5; D30/44; 244/115; 273/336, 337, 338, 339, 425, 126 R

[56] References Cited

U.S. PATENT DOCUMENTS

| | | | |
|---|---|---|---|
| 1,048,671 | 12/1912 | Fidler | 441/3 |
| 1,958,535 | 5/1934 | Elliott | 441/3 |
| 2,814,055 | 11/1957 | Phillips | 441/3 |
| 2,943,590 | 7/1960 | Andersen | 114/230 |
| 3,082,439 | 3/1963 | Hornbostel | 441/3 |
| 3,670,686 | 6/1972 | Reynolds | 114/230 |
| 4,098,214 | 7/1978 | Ogura | 114/230 |

FOREIGN PATENT DOCUMENTS

| | | | |
|---|---|---|---|
| 323606 | 6/1932 | Canada | 441/3 |

*Primary Examiner*—Trygve M. Blix
*Assistant Examiner*—Patrick W. Young
*Attorney, Agent, or Firm*—Sughrue, Mion, Zinn, Macpeak and Seas

[57] ABSTRACT

There is described a mooring device for cooperatively engaging a mooring ring, the mooring device including a circular plate, a tubular shaft passing through and fixed to the circular plate, guide rods provided between the periphery of the plate and a point along the shaft towards one end thereof, the guide rods serving to guide the mooring ring over and past the circular plate, and protruding stubs extending from the periphery of the circular plate in the direction towards the opposite end of the shaft, the opposite end of the shaft being adapted for securing to the mooring device in a mooring position.

37 Claims, 6 Drawing Figures

MOORING DEVICE

BACKGROUND OF THE INVENTION

The present invention relates to a mooring device and more particularly to a mooring device adapted for use on a dock or with a floating buoy.

Mooring devices of various sorts are of course well known. One of the simplest mooring devices is a common metal loop attached to a buoy or dock and adapted to receive mooring lines which are manually tied thereto. Tying such knots consumes time and may be difficult should the water be rough in the vicinity of the mooring device.

Typically, an approaching craft lowers a dinghy for the final approach to the buoy. The person manning the dinghy carries with him a mooring line for connection to the buoy. Obviously, at least two persons are required for this operation, one to pilot the craft and the other to man the dinghy. Moreover, in high wind/wave conditions, it is extremely difficult and sometimes dangerous for the person in the dinghy to maintain his own position relative to the buoy while at the same time attempting to control the drift of tne larger craft and of course to actually secure the mooring line to the buoy.

It is also known to dispose a loop formed on the end of a mooring line over a cleat fastened to a dock. The use of such cleats, however, requires that the loop be manipulated around the horns of the cleat, usually one at a time, and once in place, the loop is often chafed by interaction with the cleat caused by the movement of the moored boat.

Mooring devices are also known as exemplified in U.S. Pat. No. 1,958,535 issued to Harman P. Elliot. Such mooring devices have, however, relied on hooks to resist the forces exerted by a loop formed in a mooring line. Mooring loops have been known to come free from such hooks and latch means have been provided on the hooks in an attempt to mitigate this problem. As more experienced boaters are aware, however, even safety latches are not totally secure and most knowledgeable persons recommend against total reliance thereon.

SUMMARY OF THE INVENTION

Accordingly, it is an object of the present invention to provide a mooring device which obviates and mitigates from the disadvantages of the prior art.

It is a further object of the present invention to provide a mooring device which firmly and securely engages a loop or ring attached to a mooring line so that the device may be utilized by a single person steering the craft to be moored.

It is a further object of the present invention to provide a mooring device that may be securely attached to a fixed dock or to a floating buoy.

According to the present invention, then, there is provided a mooring device adapted for use in cooperation with one of either a mooring buoy and a dock and adapted to engage a mooring ring, the mooring device comprising a circular plate means; a shaft means disposed substantially perpendicularly through the circular plate means and fixedly secured thereto; an attachment portion of the shaft means being that portion of the shaft means protruding from one side of the circular plate means and adapted to be attached to one of either a buoy and a dock; a receiving portion of the shaft means being that portion of the shaft means protruding from the opposite side of the circular plate means from the attachment portion; guide means fixedly disposed between the periphery of the circular plate means and a location on the receiving portion of the shaft means in a configuration so as to provide guiding of a mooring ring, which the mooring device is adapted to engage, over and past the circular plate means in the direction from the receiving portion of the shaft means; and a plurality of protruding members attached to and distributed at spaced intervals about the periphery of the circular plate means and protruding from the side of the circular plate means from which the attachment portion of the shaft means protrudes.

BRIEF DESCRIPTION OF THE DRAWINGS

The invention disclosed herein and the advantages thereof will be more fully explained by reference hereinafter to the preferred embodiments thereof described in relation to the drawings in which.

DESCRIPTION OF PREFERRED EMBODIMENTS

It will be appreciated that the present invention may be adapted for use on a dock or as a component of a mooring buoy. However, reference will be made herein primarily to its use in a mooring buoy as it is anticipated that the present invention will be of particular interest to those who moor their craft to a floating mooring structure.

Figure 1:
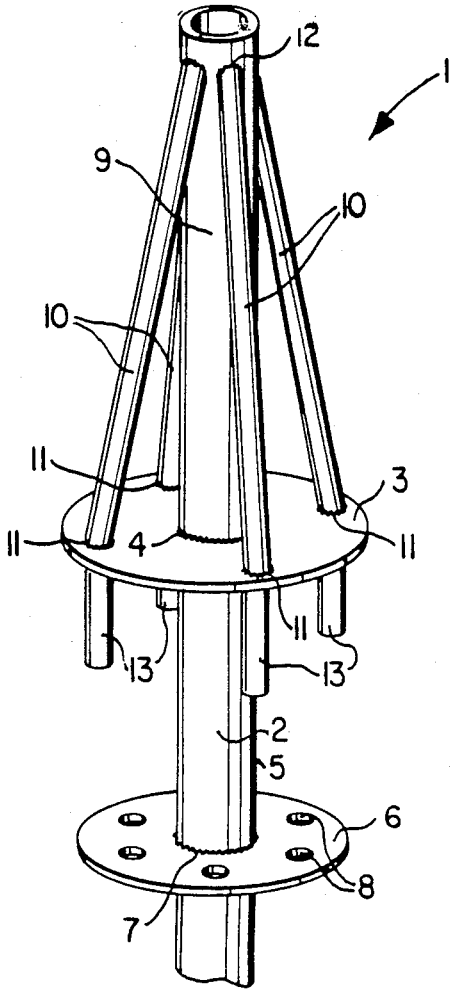
FIG. 1 illustrates a perspective view of a mooring device adapted for use with a mooring buoy.

With reference to FIG. 1 there is illustrated a mooring device 1 adapted for use as a component in a mooring buoy. A central shaft is provided by a tubular pipe 2 which is disposed perpendicularly through a metallic circular plate 3. Circular plate 3 is attached to pipe 2 by means of metallic welds at the location indicated by reference numeral 4. Pipe 2 extends below circular plate 3 as at 5 for attachment to a flotation device as will be described below.

Figure 2:
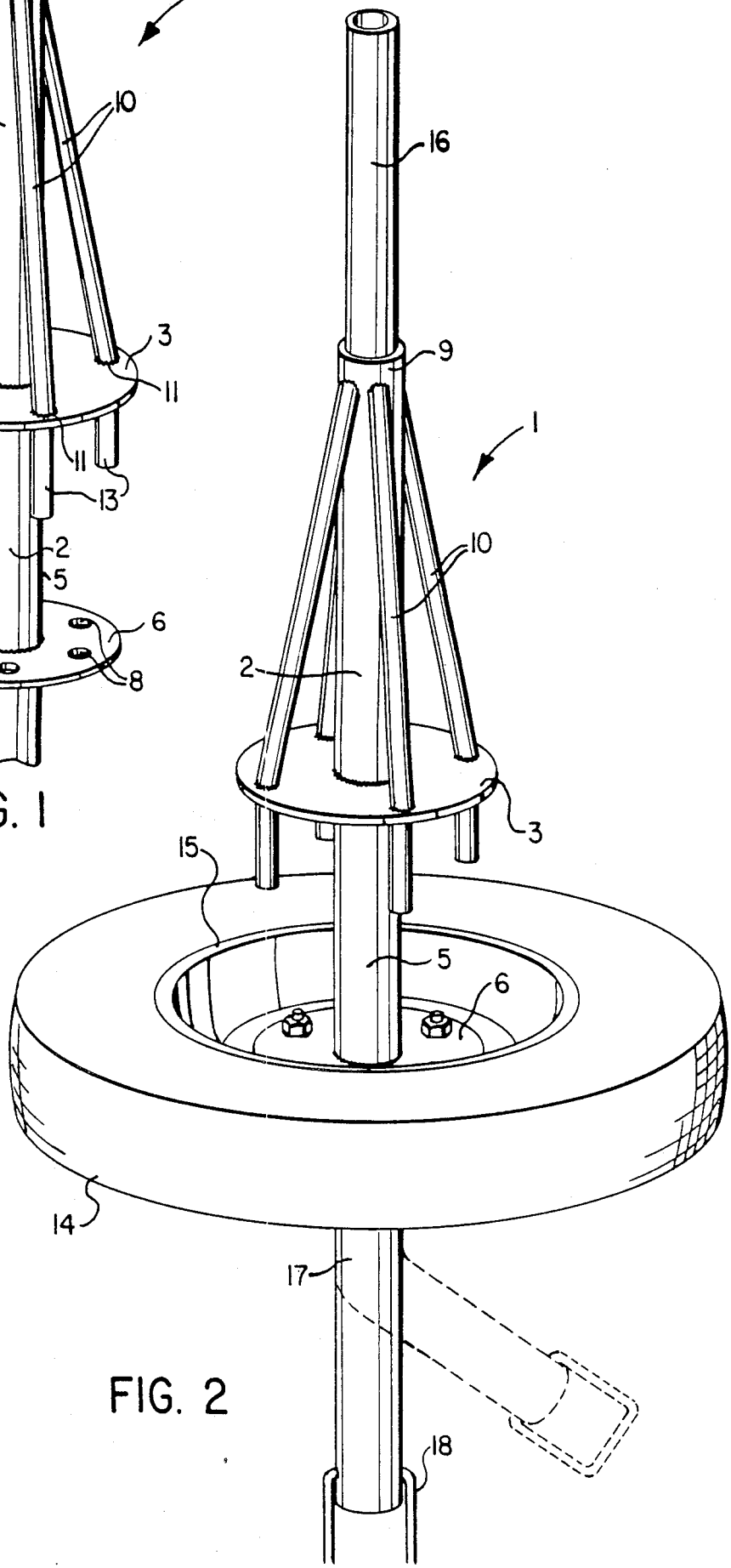
FIG. 2 illustrates a perspective view of a mooring buoy including the mooring device of FIG. 1.

An attachment disc 6 is fixed to attachment portion 5 of pipe 2 by metallic welds at the location indicated by reference numeral 7 in order to adapt attachment portion 5 of pipe 2 for attachment to a mooring buoy. The approximate position of disc 6 along portion 5 is chosen to maintain a relatively low centre of gravity for the mooring device as a whole. Bolt holes, such as shown by reference numeral 8 are provided in attachment disc 6 to receive fastening bolts therethrough for attachment to the mooring buoy (FIG. 2).

The portion of pipe 2 above circular plate 3 is designated as receiving portion 9. A plurality of mooring ring guide rods 10 are provided which extend from a point 12 along portion 9 to and through apertures 11 formed at equidistant points around the periphery of circular plate 3. Guide rods 10 may be affixed to shaft portion 9 and plate 3 such as by means of welding.

Points 12 are sufficiently above plate 3 that guide rods 10 define a steep taper from portion 9 to plate 3.

As shown, rods 10 are bent to pass through apertures 11. The portions of rod 10 extending through apertures 11 and beneath plate 3 define retaining stubs 13 which are parallel in orientation to the axis of shaft 2. As will be appreciated, guide rods 10 and stubs 13 may comprise separate pieces of rod segments appropriately welded into place on opposite sides of plate 3 rather than a single piece of rod bent to adopt the appropriate shape.

The length of retaining stubs 13 may be limited to a range between ¼ to ½ the diameter of circular plate 3 and advantageously will be approximately 2½ to 3 inches in length if the circular plate is 6 inches in diameter.

The mooring device 1 may be usefully employed in a mooring buoy as shown in FIG. 2. Attachment disc 6 is shown fastened to a wheel rim 15 carrying an inflated automobile tire 14 to provide flotation. Apertures 8 formed in attachment disc 6 are positioned to align with similar apertures in wheel rim 15 for the purpose of receiving fasteners such as bolts therethrough to complete the fastening of the mooring device to the wheel rim. It will of course be apparent that attachment disc 6 represents but one means of securing the present device to either a dock or a flotation device. For instance, attachment portion 5 of shaft 2 may be fixed directly to the mooring buoy by means of welding or clamping or any other suitable means, a number of which are well known.

There is also illustrated a lightweight pipe or guide pole 16, the lower end of which is removably received within receiving portion 9 of shaft 2 so as to be axially aligned therewith. Pole 16 is suitably fabricated from some lightweight material such as wood or tubular aluminum to minimize its unbalancing effect upon the mooring buoy as a whole. When the present mooring device is secured to a dock, guide pole 16 may be curved to advantageously extend over the water to facilitate the engagement of ring 19.

Attachment portion 5 of pipe 2 extends downwardly beneath disc 6 as at 17, terminating in a loop 18. When the mooring buoy is placed in a body of water, loop 18 is connected to an anchor (not shown) by a cable or anchor chain (also not shown) to maintain the mooring buoy in position. It has been found advantageous to deflect portion 17 at an angle of approximately 45° as shown by phantom lines in FIG. 2. The said deflection tends to reduce the tilting force otherwise exerted by the anchor chain or by the boat on shaft 2 so that the mooring device remains in a more upright position.

As will be observed from FIG. 2 wheel 15 is oriented so that the valve stem of tire 14 projects downwardly. This not only protects the valve stem from damage but lowers the present buoy's centre of gravity due to the asymmetrical construction of most wheel rims.

Figure 3:
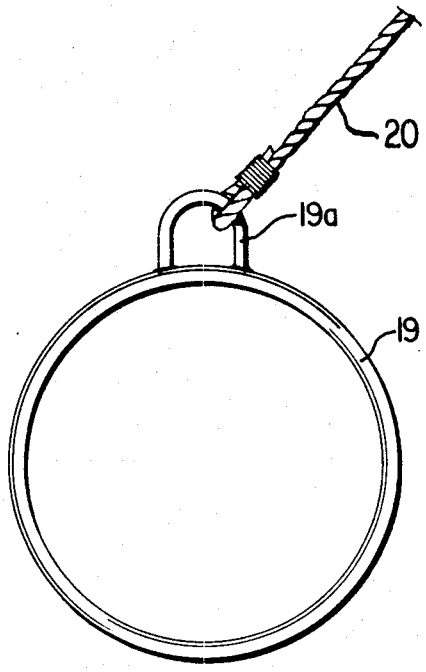
FIG. 3 illustrates a mooring ring.

FIG. 3 illustrates a circular mooring ring 19 for engaging mooring device 1 herein. As will be observed, ring 19 includes a smaller ring 19*a* to which one or more mooring lines 20 are attached by means of the usual shackles (not shown). To accommodate a minimum of two such shackles, the inner dimensions of loop 19*a* are approximately 1½" by 2".

In order to moor a boat to the mooring buoy the boat is brought along side of the mooring buoy and mooring ring 19 attached to the boat's mooring line 20 is dropped over the upward end of lightweight pole 16. The lightweight pipe 16 is generally of a length appropriate for disposing the upper end thereof at a convenient height for access by the crew of the boat which is to be moored. The mooring ring 19 falls by gravity to the upper end of receiving portion 9 of pipe 2. From there mooring ring 19 continues falling and is guided by guide rods 10 so as not to be impeded in its passage by circular plate 3. The mooring ring thus comes to rest on attachment disc 6.

It will of course be apparent that the diameter of ring 19 exceed that of plate 3. The amount of this excess is important as will be described below.

Figure 4:
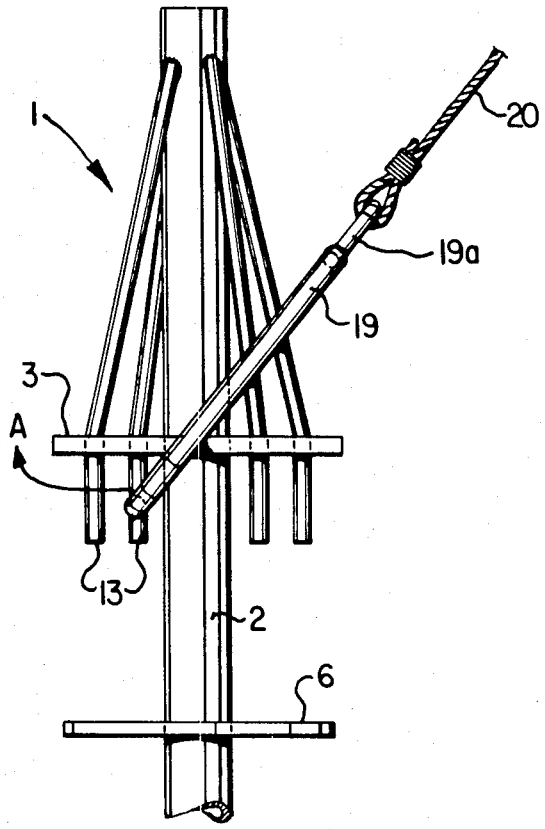
FIG. 4 illustrates an elevational view of the mooring device and ring of FIGS. 1 and 3.

When the moored boat (not shown) begins to drift, mooring ring 19 comes into contact with pipe 2 and the tension in mooring line 20 causes mooring ring 19 to slide upwardly along pipe 2 until it comes to rest jammed against two locations on the periphery of circular plate 3 as shown in FIG. 4. It will be particularly noted in this regard that ring 19 contacts and engages shaft 2 and the two opposing points on the periphery of circular plate 3. It will therefore be appreciated that protrusions 13 do not act as mere hooks to maintain ring 19 in engagement with mooring device 1. This is an important feature of the present device as will become more apparent from the further description provided below.

With mooring ring 19 in the position indicated in FIG. 4, if tension is lost in mooring line 20 for a time, one mode of movement open to the mooring ring 19 is along the periphery of the circular plate 3 in the direction of arrow "A" shown in FIG. 4. Mooring ring 19 will however be blocked from escape in this movement by retaining stubs 13 disposed about the lower periphery of circular plate 3.

Figure 5:
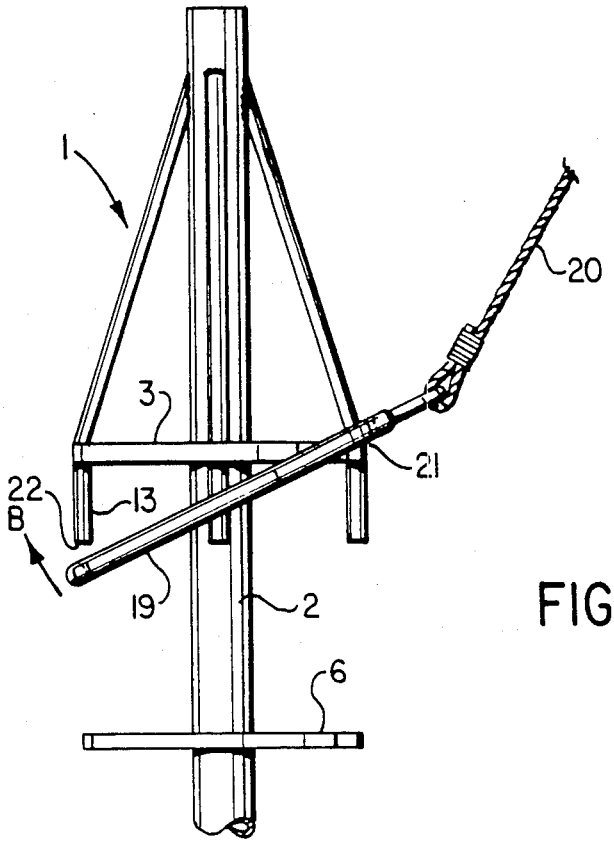
FIG. 5 illustrates another view of the device and ring of FIGS. 1 and 3.

An alternate mode of movement open to mooring ring 19 should mooring line 20 lose tension is illustrated in FIG. 5. To eliminate this possibility, the diameter of ring 19 is chosen to exceed the diameter of plate 3 by only a small amount, preferably about ⅜". Thus, so long as ring 19 reposes or is otherwise maintained at an oblique angle to shaft 2, it cannot move sufficiently far to the left of FIG. 5 to actually clear stubs 13. As will be appreciated, the restricted diameter of ring 19 relative to plate 3 results in plate 3 impeding any such leftward movement of ring 19.

To actually remove ring 19, it is necessary to substantially level the ring relative to plate 3 so that all four stubs 13 may be encompassed by the ring to facilitate its removal by lifting thereof directly past the stubs. Extensive testing has revealed that this substantially levelled attitude never occurs, as a practical matter, in the absence of deliberate and manual manipulation of ring 19 into this position.

Figure 6:
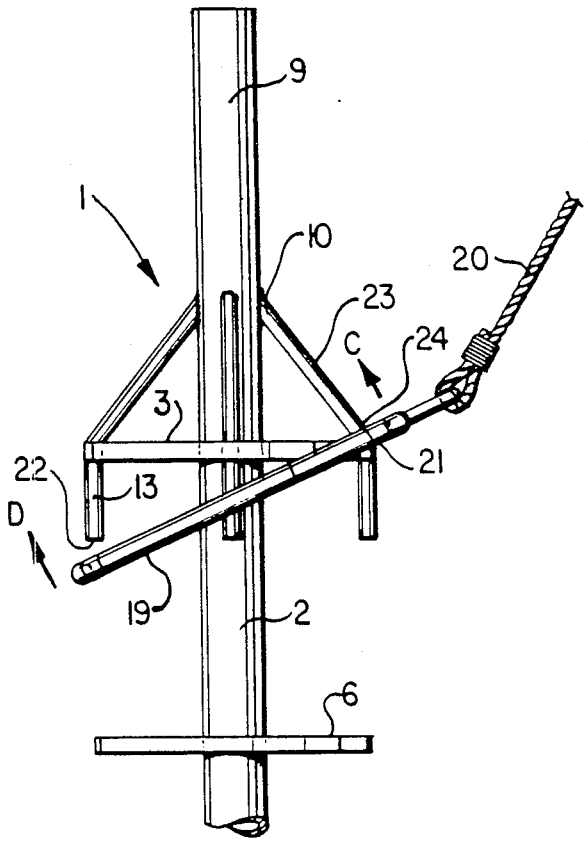
FIG. 6 illustrates yet another view of the combination of FIG. 5.

An additional possibility of escape arises as ring 19 moves in the direction indicated by arrow C in FIG. 6.

It will be appreciated that if the incline of rods 10 relative to the surface of plate 3 is too gentle, as shown, the distance between a point such as at 23 along rod 10 and the outer extremity 22 of a diametrically opposed stub 13 may be less than the internal diameter of ring 19. Under such circumstances, ring 19 could conceivably circumvent the stubs to escape by movements as indicated by arrows C and D. However, by inclining rods 10 at an angle of at least 60°, or more preferably in the range of 65° to 75°, to plate 3, the distance between points 23 and 22 will actually increase as ring 19 moves upwardly and away from plate 3 along rod 10 with the result that ring 19 cannot possibly circumvent stubs 13 to thereby become detached from the mooring device.

To utilize the present mooring device, an approaching craft need only pass close enough to guide pole 16 to enable a crewman to drop ring 19 thereover. One or two tethering lines, for instance separate lines converging from the fore and aft portions of the boat when mooring to a dock, may be secured to loop 19*a* of the ring. Accordingly, in one simple motion, which can be readily accomplished by a sole crewman, the craft will be securely moored, regardless of weather conditions. No additional tethers, knotted or otherwise, will be required.

In a preferred embodiment constructed by the applicant, the portion of shaft 2 extending below disc 6 is 18" in length, the spacing between disc 6 and circular plate 3 is 6" and guide rods 10 and stubs 13 are 8" and 2½" in length, respectively.

It will be apparent to those skilled in the art that the mooring device described herein may be adapted for use on a dock. The structural strength of a mooring device adapted for use on a dock must however be significantly greater than that of a mooring device adapted for use on a mooring buoy. Such is the case because a mooring buoy will tilt towards the direction of pull on the mooring line while a mooring device mounted on a dock would rely entirely on the structural strength of the mooring device to resist lateral forces acting on it.

While only certain embodiments of the present invention have been described, it will be apparent to those skilled in the art that various changes and modifications may be made therein without departing from the spirit and scope of the invention as claimed.

The embodiments of the invention in which an exclusive property or privilege is claimed are defined as follows:

1. A mooring device adapted for use in cooperation with one of either a mooring buoy and a dock and adapted to engage a mooring ring, said mooring device comprising a circular plate means; a shaft means disposed substantially perpendicularly through the circular plate means and fixedly secured thereto; an attachment portion of said shaft means being that portion of said shaft means protruding from one side of said circular plate means and adapted to be attached to one of either a buoy and a dock; a receiving portion of said shaft means being that portion of said shaft means protruding from the opposite side of said circular plate means from said attachment portion; guide means fixedly disposed between the periphery of said circular plate means and a location on said receiving portion of said shaft means in a configuration so as to provide guiding of a mooring ring, which the mooring device is adapted to engage, over and past said circular plate means in the direction from said receiving portion of said shaft means; and a plurality of protruding members attached to and distributed at spaced intervals about the periphery of said circular plate means and protruding from the side of said circular plate means from which the attachment portion of said shaft means protrudes.

2. A mooring device as claimed in claim 1 wherein said guide means consists of a plurality of guide members each said guide member having one end thereof securely fixed at a location on the receiving portion of said shaft means spaced from said circular plate means, said guide members individually extending from said shaft means to spaced positions on the periphery of said circular plate means at which said positions said guide members are securely fixed to the periphery of said circular plate means.

3. A mooring device as claimed in claim 2 wherein each said protruding member comprises a retaining stub disposed with the axis of the retaining stub being substantially parallel to the axis of the shaft means.

4. A mooring device as claimed in claim 3 wherein each said guide member comprises a guide rod with an axis which is substantially rectilinear.

5. A mooring device as claimed in claim 4 wherein said guide rods are fixed to the periphery of the circular plate means at substantially equally spaced positions about said periphery.

6. A mooring device as claimed in claim 5 wherein the location of fixation of said guide rods to said receiving portion of said shaft means is spaced from said circular plate means by a sufficient distance such that, for each of said guide rods, all portions thereof, excepting the portion thereof abutting the circular plate means, are more distant from the outer extremities of all retaining stubs than is the portion of the individual said guide rod abutting said circular plate means.

7. A mooring device as claimed in claim 5 wherein a retaining stub is formed with each said guide rod as an integral unit.

8. A mooring device as claimed in claim 7 wherein said integral units are four in number.

9. A mooring device as claimed in claim 3 wherein the maximum dimension of the mooring device, as measured in the plane of the circular plate means, is smaller than the diameter of the aperture of a mooring ring that the mooring device is adapted to engage.

10. A mooring device as claimed in claim 9 wherein each said guide member comprises a guide rod with an axis which is substantially rectilinear.

11. A mooring device as claimed in claim 10 wherein said guide rods are fixed to the periphery of the circular plate means at substantially equally spaced positions about said periphery.

12. A mooring device as claimed in claim 11 wherein the location of fixation of said guide rods to said receiving portion of said shaft means is spaced from said circular plate means by a sufficient distance such that for each individual said guide rod, all portions thereof, exception the portion thereof abutting the circular plate means, are more distant from the outer extremities of all retaining stubs than is the portion of the individual said guide rod abutting said circular plate means.

13. A mooring device as claimed in claim 11 wherein a retaining stub is formed with each said guide rod as an integral unit.

14. A mooring device as claimed in claim 13 wherein said integral units are four in number.

15. A mooring device as claimed in claim 9 wherein the minimum dimension of the mooring device, as measured between an outer extremity of an individual retaining stub and the outer periphery of the circular plate means diametrically opposed to the individual retaining stub, is larger than the diameter of the aperture of a mooring ring that the mooring device is adapted to engage.

16. A mooring device as claimed in claim 15 wherein each said guide member comprises a guide rod with a substantially rectilinear axis.

17. A mooring device as claimed in claim 16 wherein said guide rods are fixed to the periphery of the circular plate means at substantially equally spaced positions about said periphery.

18. A mooring device as claimed in claim 17 wherein the location of fixation of said guide rods to said receiving portion of said shaft means is spaced from said circular plate means by a sufficient distance such that for each individual said guide rod, all portions thereof, excepting the portion thereof abutting the circular plate means, are most distant from the outer extremities of all retaining stubs than is the portion of the individual said guide rod abutting the circular plate means.

19. A mooring device as claimed in claim 17 wherein a retaining stub is formed with each said guide rod as an integral unit.

20. A mooring device as claimed in claim 19 wherein said integral units are four in number.

21. A mooring device for cooperatively engaging a mooring ring, said device comprising:

circular plate means;

tubular shaft means, having first and second ends, perpendicularly passing through and fixed to said plate means;

guide means fixedly provided between the periphery of said plate means and a point on said shaft means spaced from said plate means in a direction towards said first end of the shaft means for guiding said ring member over and past said plate means; and protruding means extending from the periphery of said circular plate means in a direction towards the second end of said shaft means, wherein said second end of said shaft means is adapted for securing said mooring device in a mooring position.

22. The mooring device of claim 21 wherein said guide means comprise a plurality of elongate members individually extending diagonally from said shaft means to spaced positions on the periphery of said plate means.

23. The mooring device of claim 22 wherein said elongate members comprise guide rods, each of said guide rods being fixed to the periphery of said circular plate means at substantially equally spaced positions about said periphery.

24. The mooring device of claim 22 wherein said protruding means comprise a plurality of elongate stub members each having one end thereof fixedly connected to said circular plate means with the axis of each stub member being substantially parallel to the axis of said tubular shaft means.

25. The mooring device of claim 24 wherein said elongate members and said elongate stub members are fixed to the periphery of said circular plate means at opposed points on opposite sides of said circular plate means.

26. The mooring device of claim 25 wherein a retaining stub is formed with each said elongate member as an integral unit.

27. The mooring device of claim 26 wherein said integral units are four in number.

28. The mooring device of claim 25 wherein the length of said elongate stub members is approximately $\frac{1}{3}$ to $\frac{1}{2}$ the diameter of said plate means.

29. The mooring device of claim 22 further including guide pole means removably received within said first end of said tubular shaft means.

30. The mooring device of claim 22 wherein said second end of said shaft means is adapted for attachment to an anchor cable.

31. The mooring device of claim 29 including attachment means provided adjacent said second end of said shaft means for connecting said device to flotation means.

32. The mooring device of claim 22 including attachment means provided at said second end of said shaft means for connection of said device to a fixed platform.

33. The mooring device of claim 31 wherein said attachment means comprise a plate member fixedly secured about said shaft means, said plate member having apertures formed therethrough which align with apertures formed in said flotation means for receiving connecting members therethrough.

34. The mooring device of claim 24 wherein the diameter of said circular plate means is only slightly less than the diameter of said cooperating ring member.

35. The mooring device of claim 24 wherein the diameter of said circular plate means is in the range of $\frac{1}{4}$ to $\frac{1}{2}$ inch less than the diameter of said cooperating ring member.

36. The mooring device of claim 24 wherein the diameter of said circular plate member is $\frac{3}{8}$ inch less than the diameter of said cooperating ring member.

37. The mooring device of claim 21 wherein the diameter of said circular plate means is in the range of $\frac{1}{4}$ to $\frac{1}{2}$ inch less than the diameter of said cooperating ring member.

* * * * *